US005628363A

United States Patent [19]

Dewar et al.

[11] Patent Number: 5,628,363

[45] Date of Patent: May 13, 1997

[54] COMPOSITE CONTINUOUS SHEET FIN HEAT EXCHANGER

[75] Inventors: Douglas M. Dewar; Alexander F. Anderson, both of Rolling Hills Estates; Christopher K. Duncan, Long Beach, all of Calif.

[73] Assignee: AlliedSignal Inc., Morris Township, N.J.

[21] Appl. No.: 422,208

[22] Filed: Apr. 13, 1995

[51] Int. Cl.[6] ..... F28D 9/00

[52] U.S. Cl. ..... 165/164; 165/165; 165/905; 165/DIG. 356

[58] Field of Search ..... 165/166, 905, 165/146, 164, 165

[56] References Cited

U.S. PATENT DOCUMENTS

| | | | |
|---|---|---|---|
| T911,013 | 6/1973 | Morgans et al. . | |
| 1,662,870 | 3/1928 | Stancliffe | 165/166 |
| 3,854,186 | 12/1974 | Sergeys . | |
| 3,912,003 | 10/1975 | Schrade | 165/165 |
| 4,025,462 | 5/1977 | Cleveland | 165/166 X |
| 4,130,160 | 12/1978 | Dziedzic et al. . | |
| 4,263,966 | 4/1981 | Ostbo . | |
| 4,263,967 | 4/1981 | McNab et al. . | |
| 4,362,209 | 12/1982 | Cleveland | 165/166 |
| 4,432,408 | 2/1984 | Caines | 165/1 |
| 4,434,845 | 3/1984 | Steeb . | |
| 4,577,678 | 3/1986 | Frauenfeld et al. . | |
| 4,615,379 | 10/1986 | Kunzel . | |
| 4,771,826 | 9/1988 | Grehier et al. . | |
| 4,832,118 | 5/1989 | Scanlon et al. | 165/164 |
| 4,858,685 | 8/1989 | Szucs et al. . | |
| 4,934,455 | 6/1990 | Hasegawa | 165/166 |
| 5,025,856 | 6/1991 | Van Dyke et al. . | |
| 5,205,037 | 4/1993 | Kuriki . | |
| 5,249,359 | 10/1993 | Schubert et al. . | |

FOREIGN PATENT DOCUMENTS

| | | | |
|---|---|---|---|
| 58-35387 | 3/1983 | Japan | 165/165 |

*Primary Examiner*—Allen J. Flanigan
*Attorney, Agent, or Firm*—John R. Rafter

[57] ABSTRACT

Heat exchangers constructed of a plurality of composite ribbed sheets plates disposed and in a substantial parallel plate stacked relationship are disclosed. The sheets or plates can be spaced from each other by composite ribs or bars formed integral with or bonded to and between adjacent plates. The composite plates function as the fins of a conventional plate fin heat exchanger while the ribs form the passageways to separate adjacent fluids. The fins are specially constructed to maximize heat transfer between adjacent passageways formed by the ribs and the fluids flowing in these passageways.

16 Claims, 1 Drawing Sheet

COMPOSITE CONTINUOUS SHEET FIN HEAT EXCHANGER

This invention relates to heat exchangers and more particularly to heat exchangers constructed of a plurality of composite ribbed plates disposed in a substantial parallel stacked relationship and spaced from each other by composite ribs or bars bonded to and between adjacent plates. The composite plates form the fins of a conventional plate fin heat exchanger while the ribs form the passageways to separate the fluids. The fins are specially constructed to maximize heat transfer between adjacent passageways formed by the ribs and the fluids flowing in these passageways.

BACKGROUND

In two fluid, plate fin heat exchangers constructed of metal parts, typically a hot fluid flows between first and second adjacent plates and transfers heat to the plates. This will be referred to as the hot passageway. A cold passageway, transverse or parallel to the hot passageway is constructed on the opposite side of the second plate. A second and cooler fluid flows in this passageway. These hot and cold passageways are alternated to form a stacked array. Metal fins are provided between adjacent plates to assist the transfer of heat from the fluid in the hot passageway through the plate to the cold fluid in the second passageway. These fins are bonded to the plates providing extended heat transfer area and sufficient structural support to provide pressure containment of the fluids. To minimize flow blockage, the fins are disposed in parallel with the fluid flow and define a flow path with minimum additional flow resistance. In addition, the thickness and number of fins is such to provide a maximum heat transfer area in contact with the fluid. A thin fin satisfies these requirements and many different detailed geometry's are used to best satisfy the specific requirements of any given design problem.

Heretofore composite materials have been considered unavailable for these compact parallel plate heat exchangers. It has been considered impossible to achieve a composite fin which is sufficiently thin, sufficiently conductive and could be formed into an acceptable shape to be effective in transferring heat between the two fluids. Also, the fins must exhibit sufficient strength to support the stacked construction and provide pressure containment of the fluids.

SUMMARY OF THE PRESENT INVENTION

It is therefore an object of the present invention to provide composite fins of specially constructed materials with a higher thermal conductivity than available metals to facilitate the transfer of heat between two fluids in a compact plate fin type heat exchanger. To eliminate the need to form complex shapes with the composite materials the fins for both fluids are provided by single continuous sheets or plates.

Another object of this invention is to employ composite material construction in a heat exchanger thereby providing an improved and lightweight heat exchanger. Specific conductivity (thermal conductivity/density) is a suitable figure of merit for materials used in heat exchanger construction. Aluminum has the highest specific conductivity of all conventional heat exchanger metals with a value of 81 watts per meter K/grams per cubic centimeter. Composite materials to be used in this invention have specific conductivity's 1.5 to 2.5 times higher than aluminum or approximately in the range of 121.5–202.5 watts per meter K/grams per cubic centimeter.

Another object of this invention is to use the greatly reduced coefficient of thermal expansion of these composite materials to reduce thermal stresses and provide prolonged operating life.

Another object of the invention is also directed at prolonging service life by the inherent improved corrosion resistance of composite materials.

Another object of the invention is to employ the potential anisotropic properties of composite materials to still further improve the transfer of heat within the heat exchanger.

In accordance with a preferred embodiment a heat exchanger can be constructed of an integrated stacked array of alternating first and second composite passageways of sufficient size to accomplish the desired overall transfer of heat between the two flowing fluids therethrough. First and second composite plates disposed in substantially parallel spaced relation and separated by a plurality of ribs can define a first level including a first and second adjacent fluid flow passageways therebetween. A third composite plate can be added and spaced form the second plate by a plurality spaced composite ribs wherein the second and third plates can define a second level of first and second fluid flow passageway therebetween. The composite ribs are disposed between and bonded to said first, second and third plates of the first passageway for supporting the first, second and third plates in a stacked relation and to define a plurality of passageways therethrough.

BRIEF DESCRIPTION OF THE DRAWINGS

These and other objects and features and advantages will become more apparent from the following detailed description of the invention shown in the accompanying drawing wherein.

DETAILED DESCRIPTION OF THE PREFERRED EMBODIMENTS

Figure 1:
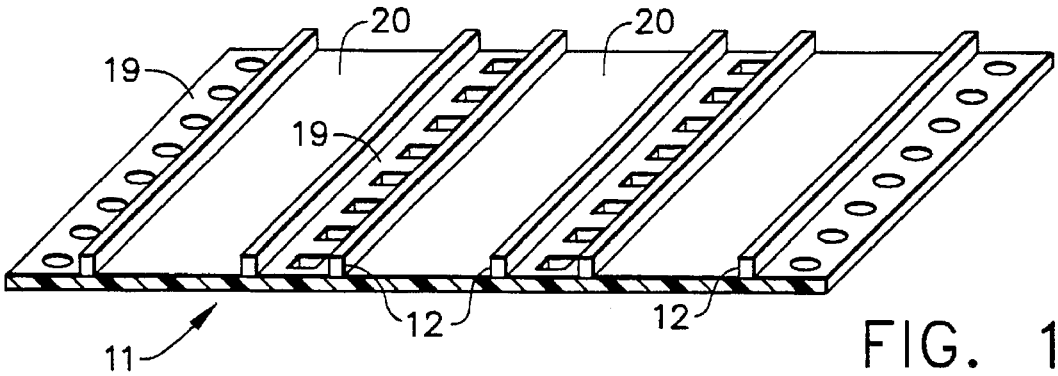
FIG. 1 is a schematic illustration of an enlarged pictorial view of perforated ribbed sheet usable in a composite heat exchanger in accordance with the present invention.
Figure 2:
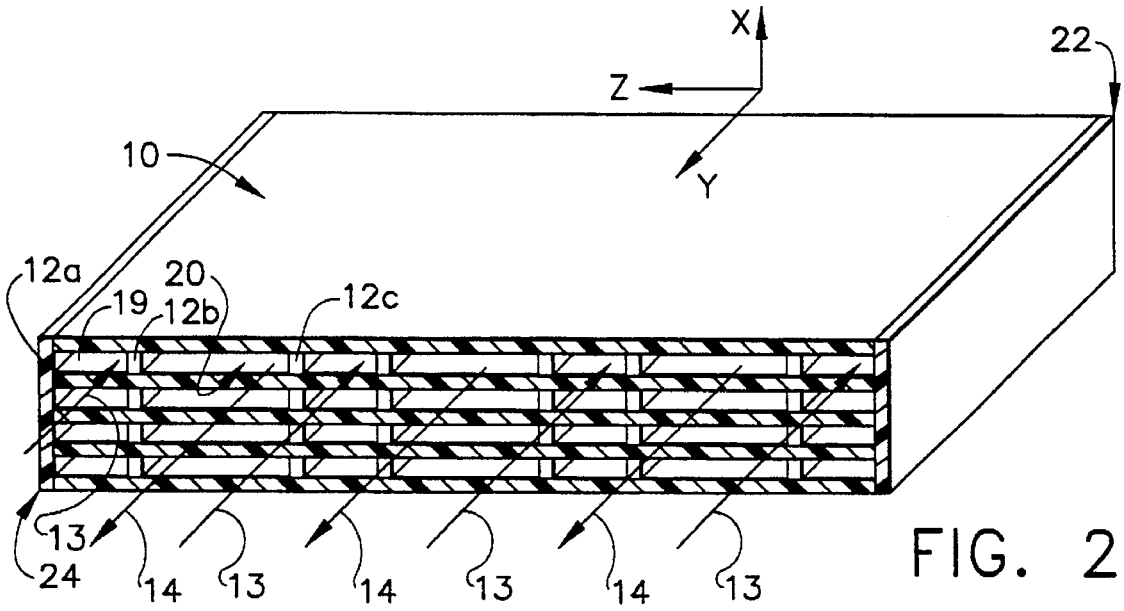
FIG. 2 is a schematically illustration of an enlarged pictorial view of the composite heat exchanger in accordance with the present invention.

Referring now to the FIGS. 1 and 2 drawing, the heat exchanger 10 comprises a plurality of flat parallel plates 11 having preferably a rectangular shape and formed from large sheets. A series of ribs or bars 12 separate the fin plates or sheets 11. The ribs or bars 12 which may be formed with or may be separate pieces bonded integral with the sheets 11. The ribs or bars 12 are also bonded to the next adjacent sheet 11 to form an integrated assembly (FIG. 1). The plates or sheets 11 act as the heat transfer fins of a plate fin heat exchanger 10 while the ribs 12 provide the separation of the two fluids more normally provided by the plates of a plate fin heat exchanger. It is intended that fluids 12 and 14, such as air or any other fluid, flow between the spaces formed by the ribs 12 in alternating layers. Thus, a first fluid 13 flows between ribs 12*a* and 12*b* while a second fluid 14 flows between ribs 12*b* and 12*c*. These two passageways formed by the ribs 12 are identified as the hot passageway 19 and the cold passageway 20. In this configuration the first and second passageways 19 and 20 are oriented to provide parallel flow of the two fluids 13 and 14 as in a counterflow heat exchanger. In this instance special provision must be added to assist the fluid entry and exit from the common face while keeping the fluids separated. In a preferred embodiment the sheets 11 with the ribs 12 can be stacked to form alternating first and second passageways 19 and 20 until the assembly as a whole provides the required heat transfer or exchange capability.

In this invention the number of fins formed by the continuous sheets 1 must be the same in both passageways 19 and 20. The differences in flow rate and pressure differential between the two fluids 13 and 14 is accommodated by varying the spacing of the ribs 12 to form passageways 19 and 20 of different heights. The fin sheets 11 can also be made to enhance the transfer of heat from the fluid to the fin surface. Surface enhancements may be in the form of perforations, artificial roughness or louvers.

Figure 3:
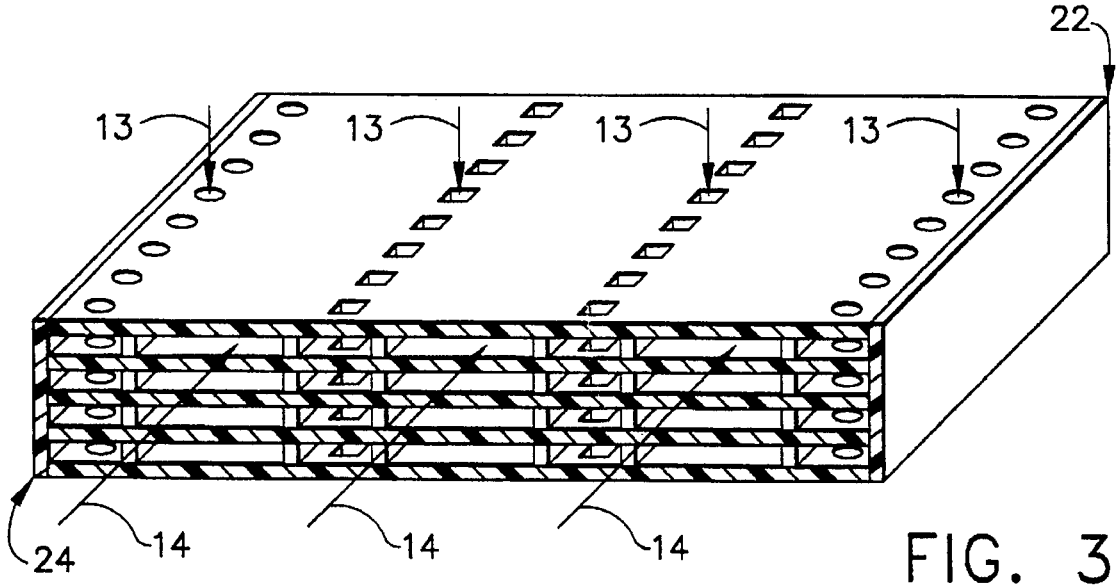
FIG. 3 is a schematic illustration of an enlarged pictorial view of the composite heat exchanger having a cross flow core flow pattern in accordance with the present invention.

In many applications of this invention it is desirable to flow the second fluid 14 transverse to the first fluid 13. This transverse flow arrangement can be achieved by provided the fin sheets 11 have perforations 15 located between ribs **12*b* and 12*c* (FIG. 1 and FIG. 3). Fluid 14 in passageway 20 is can flowing transverse or perpendicular to the fin sheets 11 and passing through the holes 15**. This surface geometry increases the rate of heat transfer to overcome the loss of conduction area.

In operation, the first and second fluids 13 and 14 flowing in the first and second passageways 19 and 20 respectively are preferably at different temperatures to facilitate the heat transfer from one passage to the other. For instance the first fluid 13 can be hotter than the second fluid 14. When this hotter fluid 13 flows in the first passageway 19 heat is transferred from the fluid to the fin sheets 11 and the ribs **12*a* and 12*b*. Heat is then transferred through the sheets 11 and the ribs 12*b* to passageway 20 and to the cooler fluid 14. The second fluid 14 exits and flows from the heat exchanger 10 and carries the exchanged heat away from the heat exchanger 10** allowing the continuous flow of the hot fluid to be continuously cooled be the continuous flow of the cold fluid.

In accordance with the present invention the higher thermal conductivity of the composite material is used to directly facilitate the heat transfer between the two fluids. The possible anisotropic nature of some composite materials can also be used to further enhance this transfer of heat. The lower density of the material can be used to reduce weight.

The two fluids in addition to the inherently unequal temperatures are at unequal pressures. The ribs 12 must be of a thickness sufficient to provide structural integrity and complete sealing between fluid passages 19 and 20 but sufficiently thin to minimize weight. Rib thickness must be gaged to account for the fluid pressure difference between passageways 19 and 20. The close spacing of the sheets 11 results in small unsupported cross sectional areas and enhances the structural integrity of the heat exchanger.

The purpose of the heat exchanger 10 is to transfer heat from one fluid to the other. Therefore if the hot fluid enters the passageway 19 as shown in the drawing, the inlet end of passage 19 is hotter than the exit end. Similarly, the cold fluid entering the passageway 20 is colder at the inlet and warmer at the exit. Thus, in the transverse flow arrangement (FIG. 2) the corner of the heat exchanger where the hot fluid enters and the cold fluid exits 22 may be at a much higher temperature than the opposite corner 24 where the cold fluid enters and the hot fluid exits. This thermal gradient within the heat exchanger structure reduces the amount of heat which can be transferred. In metal heat exchangers the hot section expands much more than the cold section which sets up adverse stresses within the material and reduces heat exchanger life. Repeated cycling of temperatures caused by varying operating conditions and by turning flows off and on still further reduces strength and life by the repeated expansion and contraction of all parts of the heat exchanger.

A method of improving heat exchanger performance and extending life is to use the correct selection of composite materials. Fibers, used in the construction of composite materials, are presently available which have a wide range of thermal conductivities. Additionally, composite materials may be anisotropic or isotropic dependent on how the fibers are oriented within the material. Isotropic materials conduct heat substantially uniformly along all three orthogonal axes X, Y and Z while anisotropic materials conduct heat predominantly along a first axis such as the Z-axis and to a lesser extent along the remaining two X and Y axes.

In the continuous sheet fin heat exchanger of this invention high thermal conductivity in the fin sheets 11 in the direction perpendicular to the ribs 12 (the Z axis) is essential. By using a high conductivity anisotropic composite material for the fins with the conduction path in the Z axis and a low conductivity material for the ribs, the conductive path from the hot corner to the cold corner is minimized and performance is maximized. An additional and significant benefit derived from the use of composite materials is that the coefficient of expansion is also much lower than conventional heat exchanger metals and this greatly reduces thermal expansion and the resultant stresses.

In accordance with this invention, it is recognized that a number of different carbon fiber and polymeric resin composites, which may be either isotropic or anisotropic, can be selected to fabricate compact parallel plate heat exchangers such that the thermal flux exceeds the value which would be achieved with an identical heat exchanger fabricated from metal. Various other modifications may be contemplated by those skilled in the art without departing from the true spirit and scope of the present invention as here and after defined by the following claims. In addition to the fin geometry and flow configurations mentioned above, the heat exchangers could be formed in other than the illustrated rectangular shape; accordingly heat exchangers of cylindrical, circular or conical configuration are within the scope of the present invention.

What we claim as our invention is:

1. A heat exchanger comprising:

first, second, and third carbon/carbon composite plates comprised of a high strength carbon fiber polymeric resin matrix including thermally conductive fibers oriented for providing anisotropic thermal conductivity in said composite plates, said plates being disposed in substantially parallel spaced relation, first and second plates defining a first fluid flow passageway therebetween and said second and third plates defining a second fluid flow passageway therebetween;

a first plurality of corrugated carbon/carbon composite fins comprised of a high strength carbon fiber polymeric resin matrix including thermally conductive fibers oriented for providing anisotropic thermal conductivity in said fins, said fins being disposed between and bonded to said first and second plates of the first passageway for supporting said first and second plates in a stacked relation and to conduct heat from said first passageway to said second plate; and a second plurality of corrugated carbon/carbon composite fins comprised of a high strength carbon fiber polymeric resin matrix including thermally conductive fibers oriented for providing anisotropic thermal conductivity in said fins, said fins being disposed between and bonded to said second and third plates of the second passageway for supporting said second and third plates in a stacked relation and to conduct heat from said second plate to said second passageway.

2. The heat exchanger of claim 1 further comprised of alternating layers of ribs and plates to form a stacked array of passageways, each of the ribs being formed by a continuous strip bonded to adjacent pairs of plates in a stacked relation to form a direct thermally conductive link between alternating passageways in alternating layers.

3. The heat exchanger of claim 1 wherein the plates and fins are selected from a class of materials comprising of the carbon/carbon composite which provides improved performance and significantly reduced weight when compared to a conventional heat exchanger.

4. The heat exchanger of claim 1 wherein each plate has a series of perforations between alternating pairs of ribs for allowing a first fluid to flow substantially parallel to the plane of the plates and a second fluid to flow through the perforations substantially transverse to the plane of sheets and in a flow direction transverse the flow direction of the first fluid.

5. The heat exchanger of claim 1 wherein the individual thermal conductances and coefficients of the plates and fins are matched for increased performance or reduced heat exchanger stress.

6. The heat exchanger of claim 1 wherein the inherent high corrosion resistance of the carbon/carbon resin based composite material extends heat exchanger service life.

7. The heat exchanger of claim 1 wherein the plates and ribs are constructed from a material selected from a class of improved thermal performance and reduced weight materials comprising a carbon fiber and polymeric resin matrix.

8. The heat exchanger of claim 1 wherein the composite plates and ribs exhibit a low coefficient of expansion and thus significantly reduce stress in the heat exchanger.

9. The heat exchanger of claim 1 where an unequal number of corrugations and/or different plate spacing of the carbon/carbon resin based composite plates creates the first and second passageways therebetween.

10. The heat exchanger of claim 1 where the first and second passageways have special increased surface geometry in the fin corrugations to maximize heat transfer between fluids.

11. The heat exchanger of claim 1 where the first and second passageways are formed by an unequal spacing of the ribs.

12. The heat exchanger of claim 1 wherein the plates have special surface geometries to maximize the heat transfer between fluids selected from the class comprising roughened surfaces, louvers, and bumps.

13. The heat exchanger of claim 1 having a specially oriented and predominant axis of thermal conductivity, as provided by an anisotropic material oriented to heat directly from passage to passage; wherein the anisotropic properties of composite materials improve the transfer of heat within the heat exchanger.

14. A heat exchanger as in claim 1 wherein the heat transfer is predominantly parallel to the plane of the plates.

15. A heat exchanger as in claim 1 wherein heat is transferred without thermal discontinuities.

16. A heat exchanger comprising:

an assembly of a plurality of substantially planar anisotropic composite plates each comprised of a high strength carbon fiber polymeric resin matrix including thermally conductive fibers oriented for providing anisotropic thermal conductivity in said composite plates, said plates being having a plurality of unequally spaced ribs applied to at least one surface of each of said plates, said plates being disposed in substantially parallel spaced relation, and first and second ribs on a first plate being spaced from each other to define a first fluid flow passageway therebetween and second and third ribs on a said first plate being separated to define a second fluid flow passageway therebetween wherein said first and second passageways are separated by the second rib and the fluid flows in the first and second passageways are substantially parallel to said first plate.

* * * * *

UNITED STATES PATENT AND TRADEMARK OFFICE
CERTIFICATE OF CORRECTION

PATENT NO : 5,628,363
DATED : May 13, 1997
INVENTOR(S) : Douglas M. Dewar; Alexander F. Anderson; Christopher K. Duncan It is certified that error appears in the above-identified patent and that said Letters Patent is hereby corrected as shown below:

Claim 1,
line 11, delete "corrugated"
line 20, delete "corrugated"

Claim 9,
line 2, delete "corrugations" and in place thereof insert – ribs--.

Claim 10,
line 3, delete "fin corrugations" and in place thereof insert – rib spacing--.

Signed and Sealed this

Twenty-fifth Day of August, 1998

Bruce Lehman

*Attest:*

BRUCE LEHMAN

*Attesting Officer*

*Commissioner of Patents and Trademarks*